US009218765B2

(12) United States Patent
Kim

(10) Patent No.: US 9,218,765 B2
(45) Date of Patent: Dec. 22, 2015

(54) DISPLAY DEVICE AND DRIVING METHOD THEREOF

(75) Inventor: Yang-Wan Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 394 days.

(21) Appl. No.: 13/229,389

(22) Filed: Sep. 9, 2011

(65) Prior Publication Data

US 2012/0062545 A1 Mar. 15, 2012

(30) Foreign Application Priority Data

Sep. 13, 2010 (KR) ..... 10-2010-0089567

(51) Int. Cl.

| | |
|---|---|
| ***G09G 5/00*** | (2006.01) |
| ***G09G 3/30*** | (2006.01) |
| ***G09G 3/36*** | (2006.01) |
| ***G09G 3/32*** | (2006.01) |

(52) U.S. Cl.

CPC ..... *G09G 3/3233* (2013.01); *G09G 3/3266* (2013.01); *G09G 2300/0819* (2013.01); *G09G 2300/0852* (2013.01); *G09G 2300/0861* (2013.01); *G09G 2310/063* (2013.01); *G09G 2320/043* (2013.01)

(58) Field of Classification Search

CPC . G09G 3/3208; G09G 3/3225; G09G 3/3291; G09G 3/325

USPC ..... 345/76, 210–213

See application file for complete search history.

(56) References Cited

U.S. PATENT DOCUMENTS

| | | | | |
|---|---|---|---|---|
| 6,362,798 | B1 | 3/2002 | Kimura et al. | |
| 2006/0125740 | A1 * | 6/2006 | Shirasaki et al. | 345/77 |
| 2008/0012818 | A1 * | 1/2008 | Lee et al. | 345/100 |
| 2008/0036704 | A1 * | 2/2008 | Kim et al. | 345/76 |
| 2009/0251455 | A1 * | 10/2009 | Park et al. | 345/214 |

FOREIGN PATENT DOCUMENTS

| | | | |
|---|---|---|---|
| JP | 06-242749 | | 9/1994 |
| KR | 100739335 | B1 | 7/2007 |
| KR | 1020070083073 | A | 8/2007 |
| KR | 100893481 | B1 | 4/2009 |

* cited by examiner

*Primary Examiner* — Alexander Eisen
*Assistant Examiner* — Amit Chatly
(74) *Attorney, Agent, or Firm* — Christie, Parker & Hale, LLP

(57) ABSTRACT

A display device and a driving method thereof are provided. The display device includes: a display unit including a plurality of pixels; a scan driver for transmitting scan signals to the plurality of pixels; a data driver for transmitting data signals to the plurality of pixels; and an initialization control driver for generating and transmitting an initialization signal to initialize data voltages corresponding to the data signals of a previous frame charged in the plurality of pixels during a first period of one frame.

24 Claims, 9 Drawing Sheets

DISPLAY DEVICE AND DRIVING METHOD THEREOF

CROSS-REFERENCE TO RELATED APPLICATION

This application claims priority to and the benefit of Korean Patent Application No. 10-2010-0089567 filed in the Korean Intellectual Property Office on Sep. 13, 2010, the entire content of which is incorporated herein by reference.

BACKGROUND

1. Field

Aspects of embodiments according to the present invention relate to a display device and a driving method thereof.

2. Description of Related Art

In recent years, various flat panel displays, with reduced weight and volume compared to that of cathode ray tube devices, have been developed. Some examples of the flat panel display devices include a liquid crystal display (LCD), a field emission display (FED), a plasma display panel (PDP), and an organic light emitting display.

Among the various flat panel displays, the organic light emitting display displays an image by using organic light emitting diodes (OLEDs) which generate light by the recombination of electrons and holes. The organic light emitting display has fast response, low power consumption, and excellent emission efficiency, luminance, and viewing angle. The organic light emitting diode (OLED) display may be classified as a passive matrix organic light emitting diode (PMOLED) display or an active matrix organic light emitting diode (AMOLED) display, according to a driving method of the OLEDs.

In the passive matrix type (PMOLED), an anode and a cathode are formed crossing each other and a cathode line and an anode line are selected to be driven. In the active matrix type (AMOLED), a thin film transistor and a capacitor are integrated in each pixel to maintain a voltage by the capacitance of the capacitor. The passive matrix type has a simple structure and thus, it has a low cost. However, the passive matrix type is not as suitable for fabricating large sized or high-resolution panels. The active matrix type, on the other hand, enables the fabrication of large-sized and high-resolution panels. However, its control method is more complex and its cost is relatively high compared to PMOLED displays. The AMOLED display, which selectively lights every unit pixel, has been widely used.

In newer AMOLED display devices, such as a portable communication device or digital imaging device, bi-directional driving is being proposed as a way to provide improved viewing angle characteristics of the display panel, as well as to allow the display panel to be reversed depending on installation positions. However, the display device including the bi-directional scan driver and a corresponding pixel circuit may have the problem of an increase in panel D/S because of an increase in circuit complexity and an increase in the number of elements. Accordingly, there is a demand for the development of a driving method of pixels that are driven by bi-directional scanning, in association with a circuit design of a scan driver for reducing the overall panel D/S in the display device by decreasing the driving circuit area of the bi-directional scan driver.

The above information disclosed in this Background section is only for enhancement of understanding of the background of the invention and therefore it may contain information that does not form the prior art that is already known in this country to a person of ordinary skill in the art.

SUMMARY

Aspects of embodiments according to the present invention relate to a display device that includes a bi-directional scan driver, which drives a display unit including a plurality of pixels in both forward and backward directions, and reduces panel D/S caused by an increase in the number of elements. Embodiments of the present invention are directed to a scan driver having a method of driving a display device by transmitting a scan signal to pixels included in a display unit in two directions, and reducing the circuit area in such a display device, and the display device including the same. Furthermore, embodiments of the present invention are directed to a method for driving pixels of a display device that is connected to a bi-directional scan driver.

According to an exemplary embodiment of the present invention, a display device is provided. The display device includes a display unit, a scan driver, a data driver, and an initialization control driver. The display unit includes a plurality of pixels. The scan driver is for transmitting scan signals to the plurality of pixels. The data driver is for transmitting data signals to the plurality of pixels. The initialization control driver is for generating and transmitting an initialization signal. The initialization signal is to initialize data voltages corresponding to the data signals of a previous frame charged in the plurality of pixels during a first period of one frame.

The display device may further include a signal controller for generating a plurality of control signals to control the driving of the scan driver, the data driver, and the initialization control driver, and for transmitting the control signals to the scan driver, the data driver, and the initialization control driver.

The scan driver may include a plurality of shift registers for generating the scan signals respectively corresponding to a plurality of pixel lines of the display unit. The plurality of shift registers may be configured to be sequentially driven in a forward or backward direction.

The control signals may include a forward driving control signal and a backward driving control signal for controlling the sequential driving of the shift registers in the forward direction or the backward direction.

The forward driving control signal may be an inverse of the backward driving control signal.

The first period may be set to an initial period of the frame.

The initialization signal may be generated and transmitted earlier than corresponding ones of the scan signals of the one frame.

Each of the plurality of pixels may include an organic light emitting diode, a driving transistor, an initialization transistor, a switching transistor, and a first capacitor. The driving transistor is for transmitting a driving current corresponding to the transmitted data signal to the organic light emitting diode. The initialization transistor is for applying an initialization voltage to a gate electrode of the driving transistor in response to the initialization signal, to reset a voltage of the gate electrode. The switching transistor is for transmitting the corresponding one of the data signals to the driving transistor in response to a corresponding one of the scan signals. The first capacitor is coupled between the gate electrode and a source electrode of the driving transistor.

Each of the plurality of pixels may further include a threshold voltage compensation transistor coupled between the gate electrode and a drain electrode of the driving transistor, for diode-connecting the driving transistor in response to the corresponding one of the scan signals.

The scan driver may include a plurality of shift registers for generating the scan signals respectively corresponding to a plurality of pixel lines of the display unit. The plurality of shift registers may be configured to be sequentially driven in a forward or backward direction.

A shift register of the plurality of shift registers may be configured to generate and transmit one of the scan signals as an input signal to a next shift register adjacent to the shift register from among the plurality of shift registers when a driving direction of the plurality of shift registers is the forward direction, and to generate and transmit the one of the scan signals as an input signal to a previous shift register adjacent to the shift register from among the plurality of shift registers when a driving direction of the plurality of shift registers is the backward direction.

The next shift register and the previous shift register may be configured to generate another one of the scan signals by receiving the input signal and shifting the same by a second period.

The plurality of shift registers may include odd-numbered shift registers and even-numbered shift registers. An odd-numbered shift register of the odd-numbered shift registers may be configured to receive, as a first input signal, one of the scan signals generated from one of the even-numbered shift registers adjacent to the odd-numbered shift register in synchronization with a first clock signal, and to output, as another one of the scan signals, either a second clock signal or a first power supply voltage corresponding to the first input signal.

The odd-numbered shift register may include a first transistor, a second transistor, a third transistor, a fourth transistor, a fifth transistor, a sixth transistor, a seventh transistor, and an eighth transistor. The first transistor may be configured to turn on in response to a forward driving control signal to transmit, as the first input signal, the one of the scan signals generated from a previous one of the even-numbered shift registers adjacent to the odd-numbered shift register. The second transistor may be configured to turn on in response to a backward driving control signal to transmit, as the first input signal, the one of the scan signals generated from a next one of the even-numbered shift registers adjacent to the odd-numbered shift register. The third transistor may be configured to turn on in response to the first clock signal to transmit the first input signal. The fourth transistor may be configured to turn on in response to the first input signal to transmit the first power supply voltage. The fifth transistor may be configured to turn on in response to a second power supply voltage transmitted corresponding to a first initial signal, to transmit the first power supply voltage. The sixth transistor may be configured to turn on in response to the first initial signal to transmit the second power supply voltage to a first node coupled to a gate electrode of the fifth transistor. The seventh transistor may be configured to turn on in response to the first input signal transmitted through the third transistor, to output the second clock signal as the other one of the scan signals. The eighth transistor may be configured to turn on in response to the second power supply voltage transmitted to the first node, to output the first power supply voltage as the other one of the scan signals.

The odd-numbered shift register may further include a first capacitor and a second capacitor. The first capacitor may include one terminal coupled to the first node and another terminal coupled to the first power supply voltage. The second capacitor may include one terminal coupled to a gate electrode of the seventh transistor and another terminal coupled to an output terminal of the odd-numbered shift register.

The second clock signal may have a phase difference with the first clock signal equal to a half of a period of the first clock signal.

The first initial signal may be generated in synchronization with the second clock signal or with a delay. A second initial signal may be generated in synchronization with the first clock signal or with a delay.

The plurality of shift registers may include odd-numbered shift registers and even-numbered shift registers. An even-numbered shift register of the even-numbered shift registers may be configured to receive, as a second input signal, one of the scan signals generated from one of the odd-numbered shift registers adjacent to the even-numbered shift register in synchronization with a second clock signal, and to output, as another one of the scan signals, either a first clock signal or a first power supply voltage corresponding to the second input signal.

The even-numbered shift register may include a ninth transistor, a tenth transistor, an eleventh transistor, a twelfth transistor, a thirteenth transistor, a fourteenth transistor, a fifteenth transistor, and a sixteenth transistor. The ninth transistor may be configured to turn on in response to a forward driving control signal to transmit, as the second input signal, the one of the scan signals generated from a previous one of the odd-numbered shift registers adjacent to the even-numbered shift register. The tenth transistor may be configured to turn on in response to a backward driving control signal to transmit, as the second input signal, the one of the scan signals generated from a next one of the odd-numbered shift registers adjacent to the even-numbered shift register. The eleventh transistor may be configured to turn on in response to the second clock signal to transmit the second input signal. The twelfth transistor may be configured to turn on in response to the second input signal to transmit the first power supply voltage. The thirteenth transistor may be configured to turn on in response to a second power supply voltage transmitted corresponding to a second initial signal, to transmit the first power supply voltage. The fourteenth transistor may be configured to turn on in response to the second initial signal to transmit the second power supply voltage to a second node coupled to a gate electrode of the thirteenth transistor. The fifteenth transistor may be configured to turn on in response to the second input signal transmitted through the eleventh transistor, to output the first clock signal as the other one of the scan signals. The sixteenth transistor may be configured to turn on in response to the second power supply voltage transmitted to the second node, to output the first power supply voltage as the other one of the scan signals.

The even-numbered shift register may further include a third capacitor and a fourth capacitor. The third capacitor may include one terminal coupled to the second node and another terminal coupled to the first power supply voltage. The fourth capacitor may include one terminal coupled to a gate electrode of the fifteenth transistor and another terminal coupled to an output terminal of the even-numbered shift register.

The second clock signal may have a phase difference with the first clock signal equal to a half of a period of the first clock signal.

A first initial signal may be generated in synchronization with the second clock signal or with a delay. The second initial signal may be generated in synchronization with the first clock signal or with a delay.

According to another exemplary embodiment of the present invention, a driving method of a display device is provided. The display device includes a plurality of pixels, a scan driver, and an initialization control driver. The plurality of pixels is arranged in a plurality of pixel lines. The scan driver is for transmitting a corresponding plurality of scan signals to the plurality of pixel lines. The initialization control driver is for transmitting an initialization signal to the plurality of pixels. Each of the plurality of pixels includes an organic light emitting diode, a driving transistor, a switching transistor, an initialization transistor, and a capacitor. The driving transistor is for controlling a current supplied to the organic light emitting diode. The switching transistor is for transmitting a data signal to the driving transistor. The initialization transistor is for transmitting an initialization voltage to a gate electrode of the driving transistor. The capacitor is coupled between the gate electrode and a source electrode of the driving transistor. The method includes concurrently transmitting the initialization signal to the plurality of pixels during a first period of one frame to initialize a gate electrode voltage of the driving transistor to the initialization voltage, and sequentially transmitting the plurality of scan signals to the corresponding plurality of pixel lines during a second period of the one frame to display an image by a driving current corresponding to the data signal for each of the plurality of pixels.

Each of the plurality of pixels may further include a threshold voltage compensation transistor coupled between the gate electrode and a drain electrode of the driving transistor. The method may further include compensating for a threshold voltage in each of the plurality of pixels by turning on the threshold voltage compensation transistor to diode-connect the driving transistor when a corresponding one of the scan signals is transmitted.

The method may further include choosing a scan driving direction from among a forward direction and a backward direction. The sequentially transmitting the plurality of scan signals to the corresponding plurality of pixel lines may further include sequentially transmitting the plurality of scan signals according to the chosen scan driving direction.

The first period of the one frame may precede the second period of the one frame.

According to embodiments of the present invention, a scan driver for transmitting scan signals to each of the pixels of the display unit in both directions and driving the pixels in various ways, and an organic light emitting diode (OLED) display including the same, can be provided by realizing a bi-directional scan driver with a simple circuit configuration and a small installation area. Moreover, it is possible to provide a driving method of each of the pixels of the display unit that is connected to the bi-directional scan driver and easily applicable to the driving of the bi-directional scan driver by a simple driving operation.

Due to this, the bi-directional scan driver can be driven while reducing the overall panel D/S of the display device, and the pixel circuit can be driven corresponding to bi-directional driving. Hence, up/down inverted images can be displayed as desired, thus improving the convenience of use and application of the OLED display device.

It is to be understood that aspects of embodiments of the present invention will not be limited to the aforementioned description, and other aspects will be apparent to those skilled in the art to which the present invention pertains, from the following detailed description of exemplary embodiments of the present invention.

BRIEF DESCRIPTION OF THE DRAWINGS

The accompanying drawings illustrate embodiments of the present invention, and together with the description, serve to explain aspects and principles of the present invention.

DETAILED DESCRIPTION

Figure 1:
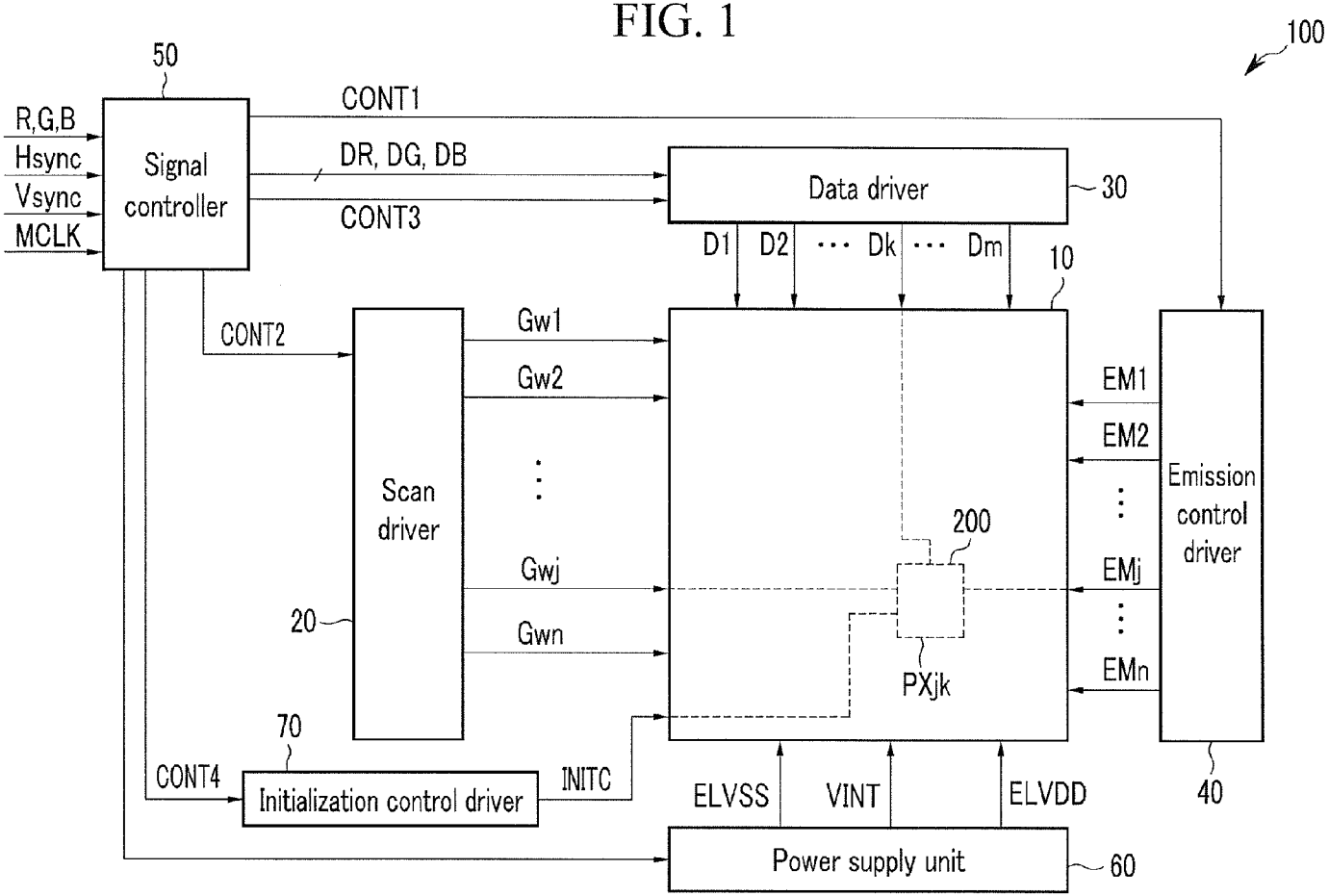
FIG. 1 is a block diagram of a display device according to one exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention.

For various exemplary embodiments, constituent elements having the same constitution are designated with the same reference numerals and explained representatively in the first exemplary embodiment. In other exemplary embodiments, only constituent elements that are different from those in the first exemplary embodiment are described.

To more clearly explain embodiments of the present invention, descriptions of portions not needed for a full understanding may be omitted. In addition, same or substantially the same constituent elements are designated with the same reference numerals throughout.

Throughout this specification and the claims that follow, when it is described that an element is "coupled" to another element, the element may be directly coupled (e.g., connected) to the other element or indirectly coupled (e.g., electrically coupled) to the other element through one or more third elements. In addition, unless explicitly described to the contrary, the word "comprise" and variations such as "comprises" or "comprising," will be understood to imply the inclusion of stated elements but not necessarily the exclusion of any other elements.

An active matrix organic light emitting diode (AMOLED) display may include a display unit including pixels arranged in a matrix; a data driver to transmit a data signal to data lines coupled to the pixels; and a scan driver to transmit a scan signal to scan lines coupled to the pixels. In a driving method of the scan driver, a plurality of shift registers included in the scan driver may select pixels for each line with which to sequentially supply a scan signal every horizontal period. The data driver may supply the data signal to the pixels selected for each line by the scan signal. Then, each of the pixels may supply current corresponding to the data signal to an organic light emitting diode (OLED) to display an image corresponding to the data signal.

Such an AMOLED display may employ unidirectional driving (for example, in a forward direction or a backward direction), in which the scan driver sequentially transmits the scan signal to pixels. However, unidirectional driving may not be suitable for applications such as a portable communication device or a digital imaging device, which have different viewing angle characteristics than traditional display devices, and whose display panel can be reversed depending on installation positions. Thus, bi-directional driving (for example, capable of going both in a forward direction and in a backward direction) may be more appropriate for these devices.

In an exemplary bi-directional driving method embodiment, a scan driver uses a scan signal generated at the previous stage or a scan signal to be generated at the next stage when generating a scan signal of a corresponding current stage. Moreover, each of a plurality of pixels uses both the scan signal generated at the previous stage and the scan signal generated at the current stage. This can result in an increase in panel D/S because of increased circuit complexity and an increase in the number of elements.

FIG. 1 is a block diagram showing a structure of a display device 100 according to one exemplary embodiment of the present invention.

The display device 100 includes a display unit 10 including a plurality of pixels 200, a scan driver 20 for transmitting a plurality of scan signals to the display unit 10, a data driver 30 for transmitting a plurality of data signals to the display unit 10, an emission control driver 40 for transmitting a plurality of emission control signals to the display unit 10, a power supply unit 60 for supplying a driving power to the display unit 10, an initialization control driver 70 for generating and transmitting an initialization signal to each of the plurality of pixels 200 included in the display unit 10, and a signal controller 50 for supplying a plurality of control signals to control the signals generated and transmitted from the scan driver 20, the data driver 30, the emission control driver 40, and the initialization control driver 70.

The plurality of pixels 200 are arranged in a matrix (for example, rows and columns). Each of the pixels 200 includes an organic light emitting diode (OLED) that emits light corresponding to a flow of driving current in response to the data signals transmitted from the data driver 30.

In each of the plurality of pixels 200 included in the display unit 10, a plurality of scan lines Gw1 to Gwn formed in a row direction for transmitting scan signals and a plurality of data lines D1 to Dm formed in a column direction for transmitting data signals are arranged. In each of the plurality of pixels 200, a plurality of emission control lines EM1 to EMn formed in the row direction for transmitting light emission signals are further arranged.

Moreover, each of the plurality of pixels 200 is coupled to an initialization control line INITC coupled to the initialization control driver 70, and receives an initialization signal from the initialization control driver 70. That is, among the plurality of pixels 200, the pixel PXjk positioned in the j-th pixel row (or j-th pixel line) and the k-th pixel column is coupled to its corresponding scan line Gwj, data line Dk, and emission control line Emj, as well as the initialization control line INITC. However, this is merely an example and other embodiments are not necessarily limited to such a configuration and structure, and various configurations and structures can be employed.

The pixels 200 supply current to the OLEDs in response to their corresponding data signals. The OLEDs in turn emit light at a luminance according to the supplied current. A first power supply voltage (ELVDD), second power supply voltage (ELVSS), and initial power supply voltage (VINT) used for the operation of the display unit 10 are transmitted from the power supply unit 60.

The scan driver 20 is for applying a plurality of scan signals to the display unit 10. The scan driver 20 is coupled to the plurality of scan lines Gw1 to Gwn and transmits the plurality of scan signals to the corresponding scan lines Gw1 to Gwn. The scan driver 20 generates the scan signals and transmits them to the scan lines Gw1 to Gwn coupled to a plurality of pixel rows included in the display unit 10 in response to a scan driving control signal CONT2 supplied from the signal controller 50. The scan driver's detailed circuit configuration will be described later. The scan driver 20 according to one exemplary embodiment of the present invention can freely generate and transmit scan signals applied to one corresponding scan line among the plurality of scan lines Gw1 to Gwn even in the case of bi-directional driving (that is, in either one of two directions, for example, forward and reverse).

Before the scan driver 20 generates scan signals and transmits them respectively to the plurality of pixels 200, the initialization control driver 70 supplies an initialization signal to all of the plurality of pixels 200 through the initialization control line INITC coupled to the pixels 200 to initialize a data voltage of a previous frame stored in each of the pixels 200. The initialization control driver 70 operates in response to an initialization control signal CONT4 transmitted from the signal controller 50 when generating and transmitting an initialization signal to each of the plurality of pixels 200.

The data driver 30 generates a plurality of data signals from image data signals DR, DG, and DB transmitted from the signal controller 50, and transmits them to the plurality of data lines D1 to Dm coupled to the display unit 10. The data driver 30 operates by a data driving control signal CONT3 supplied from the signal controller 50.

The emission control driver 40 generates a plurality of emission control signals and transmits them to the plurality of emission control lines EM1 to EMn coupled to the display unit 10 in response to an emission control driving control signal CONT1. The plurality of pixels 200 included in the display unit 10 receives corresponding emission control signals, and accordingly makes the OLEDs emit light by data voltages corresponding to the data signals to display an image. The scan driver 20 included in the display device 100 may have a similar configuration as in the block diagram of FIG. 2, which scans and drives the pixels 200 of the display unit 10 in one direction.

Figure 2:
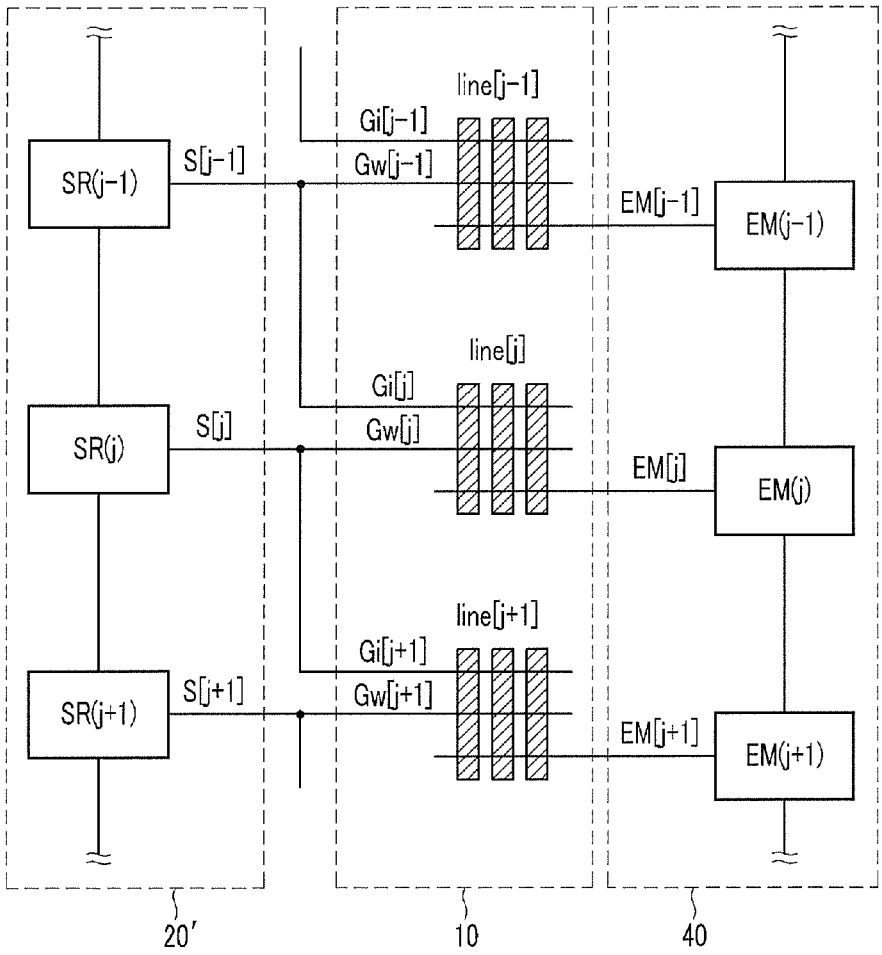
FIG. 2 is a block diagram of a display device including a scan driver and pixels according to a comparable embodiment.

FIG. 2 is a block diagram showing a partial configuration of a display device 100 according to a comparable embodiment. Specifically, FIG. 2 is a schematic view of some shift registers of the scan driver 20' and emission control driver 40 coupled to the scan lines Gw1 to Gwn and emission control lines that are in turn coupled to the display unit 10.

Referring to FIG. 2, the scan driver 20' in the comparable embodiment includes a plurality of shift registers SR(1) to SR(n) corresponding to the scan lines Gw1 to Gwn coupled to pixel lines of the display unit 10. Particularly, since each of the scan lines Gw1 to Gwn is coupled to receive an output signal of the shift register of the previous stage of the scan driver 20' as an initialization signal for initializing respective data voltages of the plurality of pixels, at least two scan lines (for transmitting at least two types of scan signals) are coupled to each pixel line of the display unit 10. That is, an output signal output from the output stage of the shift register of the scan driver 20' corresponding to a pixel line is concurrently (for example, simultaneously) supplied to the scan line coupled to the pixel line and the scan line coupled to the next pixel line. Moreover, the output signal is used as an input signal of the shift register of the next stage.

For example, a (j−1)-th output signal S[j−1] output from the (j−1)-th shift register SR(j−1) of the scan driver 20' coupled to the (j−1)-th scan line Gwj−1 coupled to the (j−1)-th pixel line of the display unit 10 is transmitted as a (j−1)-th scan signal Gw[j−1] to each of the plurality of pixels included in the (j−1)-th pixel line and, concurrently (for example, at the same time), transmitted as a j-th initialization signal Gi[j] to each of the plurality of pixels included in the next (that is, the j-th) pixel line. Further, the (j−1)-th output signal S[j−1] of the (j−1)-th shift register SR(j−1) is transmitted as an input signal to the j-th shift register SR(j) of the next stage.

Then, the j-th shift register SR(j) operates to generate a j-th output signal S[j], and the j-th output signal S[j] is transmitted as a j-th scan signal Gw[j] to each of the plurality of pixels included in the j-th pixel line and, concurrently (for example, at the same time), transmitted as a (j+1)-th initialization signal Gi[j+1] to each of the pixels included in the (j+1)-th pixel line of the next stage.

Thus, the scan driver 20', configured to supply an initialization signal as well as a scan signal to each of the plurality of pixels, becomes relatively complex. Also, in an alternative comparable embodiment, another scan driver having a different structure in addition to the comparable scan driver 20' as shown in FIG. 2. This scan driver has a structure in which a plurality of shift registers of one corresponding stage are provided to generate both an initialization signal and a scan signal to be transmitted to a pixel line from the corresponding stage. Accordingly, there arises the problem of an increase in the overall panel D/S due to an increase in the number of elements of the scan driver and an increase in the area occupied by the elements.

Figure 3:
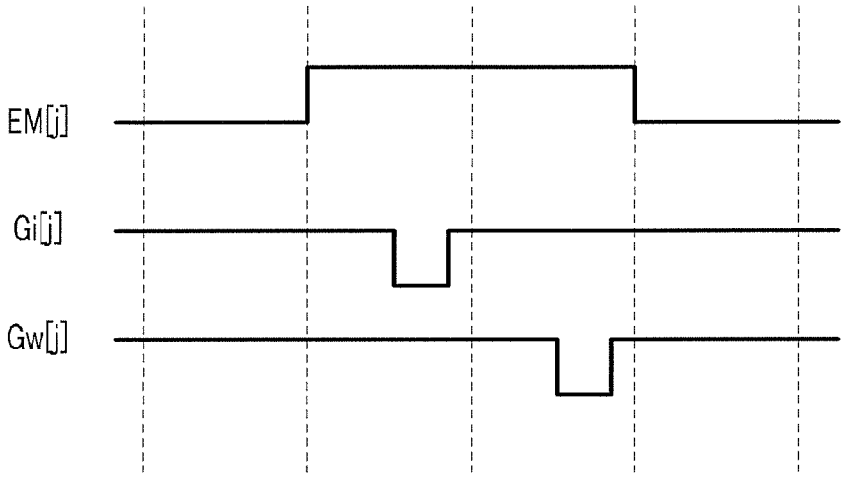
FIG. 3 is a signal waveform diagram showing driving signals of a comparable display device.

The comparable bi-directional scan driver 20', when modified to be driven in two directions while generating and transmitting both an initialization signal and a scan signal sequentially, is driven as shown in the signal waveform diagram of FIG. 3 by transmitting an initialization signal and a scan signal to a plurality of pixels included in each pixel line. That is, referring to the signal waveform diagram of FIG. 3, a j-th initialization signal Gi[j] corresponding to the j-th pixel line among a plurality of scan signals generated by the comparable scan driver 20' and a j-th scan signal Gw[j] corresponding to the j-th pixel line among a plurality of scan signals are sequentially transmitted to each of the plurality of pixels of the j-th pixel line, and a j-th emission control signal EM[j] is transmitted to thus make the plurality of pixels of the j-th pixel line emit light and display an image.

The scan driver 20' for generating an initialization signal and a scan signal to scan lines coupled to corresponding to pixel lines in the comparable driving method has to generate two types of signals for each line and control such that the initialization signal is transmitted earlier than the scan signal. As a result, the circuit design becomes complicated and the number of elements is increased, thereby causing inconvenience in the process, such as an increase in area, and making the process less economical.

Therefore, an exemplary scan driver of embodiments of the present invention is adapted to supply a scan signal according to a simple circuit design and configuration in which the number of elements is decreased to reduce the area occupied by the elements. The scan driver is further adapted to generate and transmit an initialization signal to be supplied to a pixel coupled to the scan driver by the initialization control driver 70, which is separately provided. Moreover, the display device including the scan driver of embodiments of the present invention is for performing signal driving and control in a complicated driving circuit of a display panel that further provides bi-directional scan driving.

Figure 4:
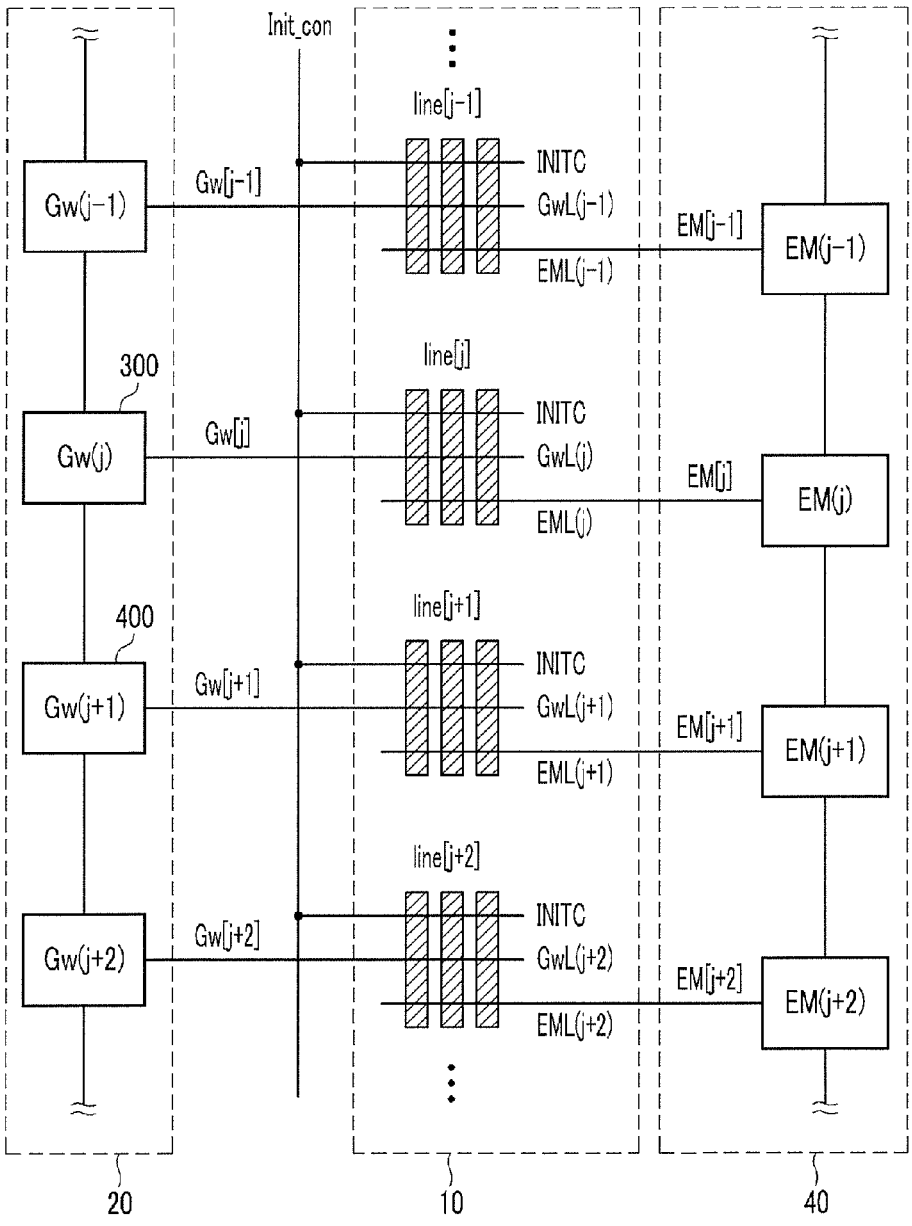
FIG. 4 is a block diagram of a display device including a scan driver and pixels according to one exemplary embodiment of the present invention.

FIG. 4 is a block diagram of a display device including portions of the scan driver 20 and the display unit 10 including a plurality of pixels according to one exemplary embodiment of the present invention.

Figure 5:
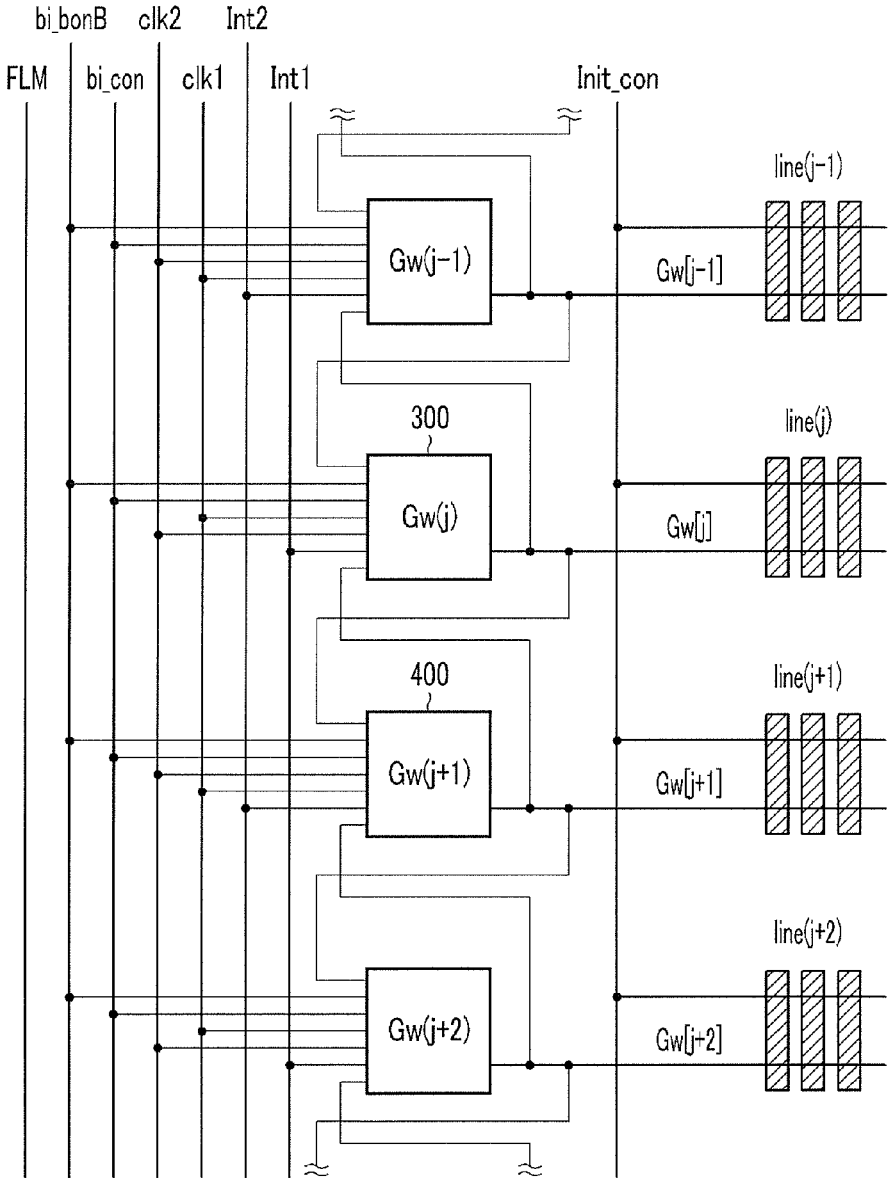
FIG. 5 is a block diagram of a display device including a bi-directional scan driver and pixels according to one exemplary embodiment of the present invention.

The scan driver 20 as shown in FIG. 4 may be a bi-directional scan driver. FIG. 5 shows a block diagram of a display device including portions of the bi-directional scan driver 20 and the display unit 10 including a plurality of pixels.

First, the display device disclosed in FIG. 4 includes portions of each of a scan driver 20 for generating and transmitting scan signals to scan lines coupled to each pixel line of a display unit 10. The display unit 10 includes a plurality of pixels for concurrently (for example simultaneously) receiving a plurality of scan signals transmitted from the scan driver 20 along with an initialization signal, and an emission control driver 40 for generating and transmitting a plurality of emission control signals to the plurality of pixels.

The scan driver 20 of FIG. 4 has a simple circuit structure that includes a plurality of shift registers for generating and transmitting one scan signal to each of the plurality of pixel lines of the display unit 10. That is, even if the scan driver 20 according to the exemplary embodiment of FIG. 4 is designed to perform a forward driving operation for driving sequentially from an upper stage shift register to a lower stage shift register (for example, from an "upper" portion of a display to a "lower" portion of the display) or a backward driving operation for driving sequentially from a lower stage to an upper stage (for example, from a lower portion of the display to an upper portion of the display), each of the plurality of shift registers supplies one output signal as a scan signal, thus making the circuit configuration simple. A block diagram of the display device having a bi-directional scan driver will be described later in FIG. 5.

Referring to FIG. 4, an initialization signal Init_con is transmitted to all of the plurality of pixels through an initialization control line INITC to initialize a data voltage stored in each of the pixels included in the display unit 10. This makes the reset control of the pixels convenient and easy.

In FIG. 4, one scan line GwL and one emission control line EML are coupled to each pixel line of the display unit 10 including a plurality of pixels. Although not shown in FIG. 4, when a data line is coupled to each of the pixels included in each pixel line and the corresponding pixel is selected by a scan signal, a data signal is transmitted through the data line. In addition to the scan line GwL and emission control line EML coupled to each pixel line, an initialization control line INITC is further coupled to the pixel line.

The scan driver 20 of FIG. 4 includes a plurality of shift registers Gw(1) to Gw(n) (shown as . . . , Gw(j−1), Gw(j), Gw(j+1), Gw(j+2), . . . ) corresponding to the respective pixel lines of the display unit 10, the stages of which are sequentially coupled to adjacent stages. The shift registers Gw(1) to Gw(n) are respectively coupled to the scan lines GwL(1) to GwL(n) coupled to the plurality of pixel lines to supply scan signals Gw[1] to Gw[n].

Moreover, the initialization signal Init_con is transmitted concurrently (for example, simultaneously) to all the pixels included in the display unit 10 through the initialization control line INITC coupled to each pixel line of the display unit 10 to thus reset the data voltages of all the pixels. The initialization control line INITC is coupled to the initialization control driver 70 shown in FIG. 1, and transmits the initialization signal Init_con generated and transmitted by the initialization control driver 70 to all the pixels.

In addition, the shift register 300 (that is, the shift register Gw(j)) of the j-th stage of the scan driver 20 corresponding to the j-th pixel line is coupled to a j-th scan line GwL(j) coupled to the j-th pixel line to generate and transmit a j-th scan signal Gw[j]. Concurrently (for example, at the same time), the generated j-th scan signal Gw[j] is transmitted as an input signal to the (j+1)-th stage shift register Gw(j+1) 400 of the next stage.

The driving method according to one exemplary embodiment of the present invention is also applicable to the scan driver 20 of a forward driving type as shown in FIG. 4 and to the scan driver 20 of a bi-directional driving type as shown in FIG. 5. While the bi-directional scan driver may, in comparable embodiments, cause an increase in panel D/S because the circuit configuration is more complex and the number of elements is increased, the driving method as shown in FIG. 5 can reduce the number of elements and reduce the panel D/S because the scan driver 20 does not need to generate and transmit an initialization signal for initialization of a plurality of pixels, which may make this method an improvement over that of comparable embodiments.

For the sake of convenience, FIG. 5 illustrates a portion of the shift registers included in the scan driver 20 and a portion of the pixel lines of the display unit 10. The scan driver 20 as shown in FIG. 5 includes a plurality of shift registers ( . . . Gw(j−1), Gw(j), Gw(j+1), Gw(j+2) . . . ). Each of the shift registers is coupled to a scan line coupled to a corresponding pixel line among the plurality of pixel lines of the display unit 10 to generate and transmit scan signals ( . . . Gw[j−1], Gw[j], Gw[j+1], Gw[j+2] . . . ). In addition, an initialization control line is coupled to each of the plurality of pixel lines, and an initialization signal Init_con is transmitted to all the pixels included in the plurality of pixel lines.

The scan driver 20 of FIG. 5 performs driving in two directions. An output signal of the shift register of a corresponding stage is supplied as a scan signal to a scan line coupled to the shift register of the corresponding stage. Concurrently (for example, at the same time), the output signal is transmitted as an input signal to the shift register of the next stage in the case of forward driving, whereas the output signal is transmitted as an input signal to the shift register of the previous stage in the case of backward driving.

Further, the plurality of shift registers of the scan driver 20 receive, as input signals, a driving direction control signal for determining a forward or backward driving direction, a clock signal, an initial signal, etc. In addition, the shift registers receive, as an input signal, a start signal for driving the shift register of the first stage. The types and number of input signals to be input into the shift registers are not limited, and the design of the circuit configuration may be modified as long as it has the technical characteristics of embodiments of the present invention. The design is not limited to the circuit configuration of any particular embodiment of the present invention.

For example, referring to the scan driver 20 of FIG. 5, a forward driving control signal bi_conB and a backward driving control signal bi_con are input into each of the plurality of shift registers. Moreover, a first clock signal clk1 and a second clock signal clk2 are concurrently (for example, simultaneously) supplied in an alternating fashion to the shift register of each stage. Further, one of a first initial signal Int1 and a second initial signal Int2 is alternately supplied to the shift register of each stage.

In one embodiment, the forward driving control signal bi_conB, the backward driving control signal bi_con, the first clock signal clk1, the second clock signal clk2, and the first initial signal Int1 are supplied to the shift register of an odd-numbered stage, and the forward driving control signal bi_conB, the backward driving control signal bi_con, the first clock signal clk1, the second clock signal clk2, and the second initial signal Int2 may be supplied to the shift register of an even-numbered stage. However, the present invention is not necessarily limited to such a circuit configuration and signal transmission.

In FIG. 5, the shift register Gw(j) of the j-th stage is assumed to be an odd-numbered shift register. Although the first and last stages of the scan driver 20 are not shown in the block diagram of FIG. 5, after the scan driving direction is determined as being forward or backward, a forward start signal is input into the shift register of the first stage or a backward start signal is input into the shift register of the last stage. The forward start signal and the backward start signal in FIG. 5 are commonly denoted by FLM.

Meanwhile, after receiving the plurality of input signals, an output signal is generated and transmitted as a scan signal to a corresponding pixel line. Concurrently (for example, at the same time), the generated output signal is transmitted as an input signal to the input terminal of the shift register of the next stage or the previous stage depending on whether the scan driving direction is forward or backward driving.

Each of the plurality of pixels included in the corresponding pixel line is selected in response to the transmitted scan signal after the data voltage is initialized in response to the initialization signal Init_con, and receives a data voltage corresponding to a data signal transmitted from a new frame, thereby displaying an image. More specifically, if the driving direction selected in response to the forward driving control signal bi_conB of the scan driver 20 is forward, going down from the top of the display unit 10, the j-th scan signal Gw[j] generated from the j-th stage shift register 300 is supplied to the input terminal of the (j+1)-th stage shift register 400 of the next stage to drive the (j+1)-th stage shift register 400. In contrast, if the driving direction is backward, going up from the bottom of the display unit 10, the j-th scan signal Gw[j] generated from the j-th stage shift register 300 is supplied to the input terminal of the (j−1)-th stage shift register Gw(j−1), which is at the previous stage, to drive the (j−1)-th stage shift register Gw(j−1).

Figure 6:
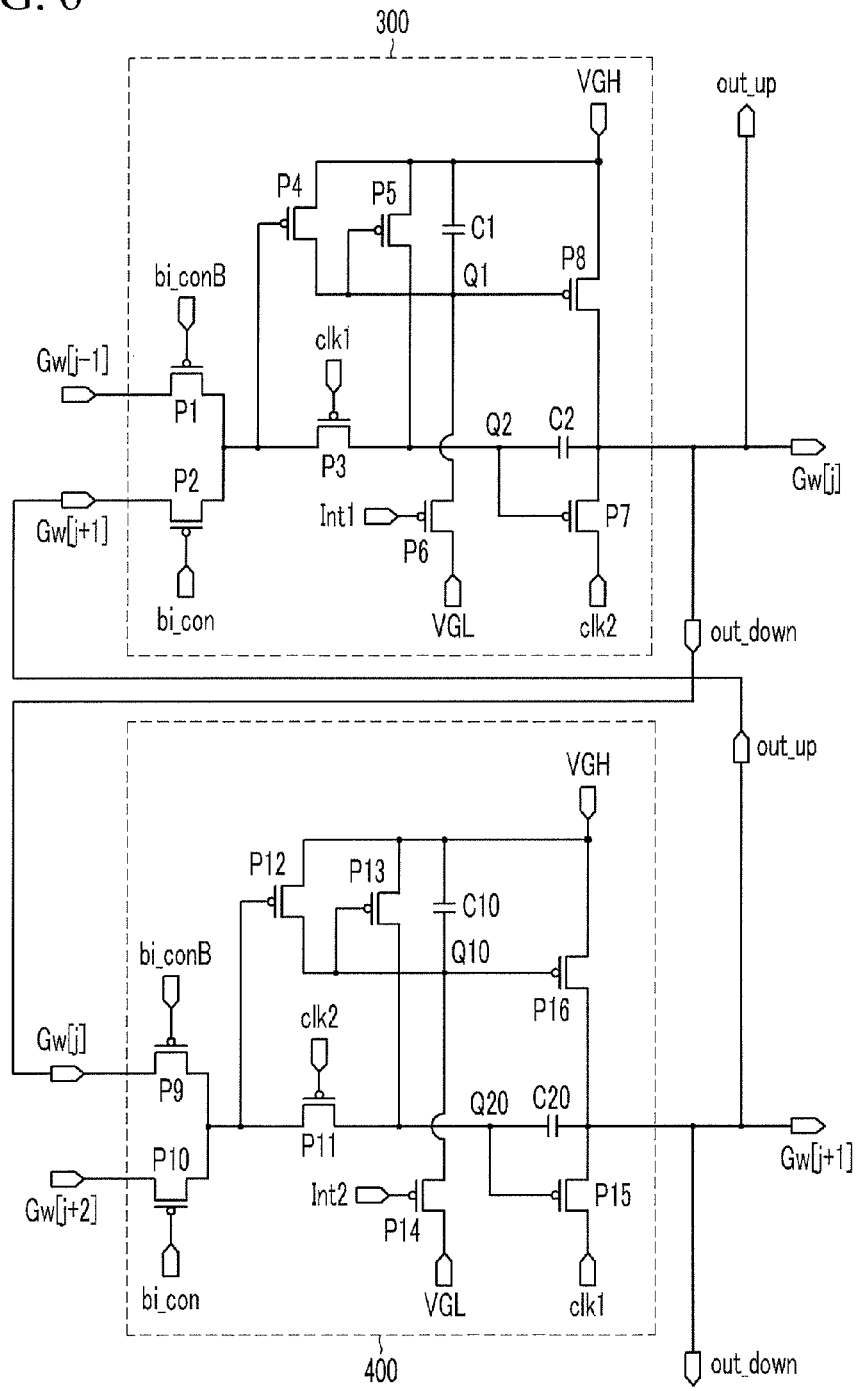
FIG. 6 is a circuit diagram of the bi-directional scan driver according to one exemplary embodiment of the present invention.

A circuit configuration diagram according to one exemplary embodiment of the scan driver 20 shown in FIG. 5 is shown in FIG. 6. The circuit diagram of the scan driver 20 shown in FIG. 6 relates to the j-th stage shift register 300 and the (j+1)-th stage shift register 400 of the next stage among the plurality of shift registers.

The j-th stage shift register 300 has two input terminals for receiving the (j−1)-th scan signal Gw[j−1] transmitted from the (j−1)-th shift register (see, for example, (j−1)-th shift register Gw(j−1) in FIG. 5) of the previous (j−1)-th stage and the (j+1)-th scan signal Gw[j+1] transmitted from the (j+1)-th stage shift register 400 of the next stage. In addition, the j-th stage shift register 300 has one output terminal, and generates and outputs a j-th scan signal Gw[j] by the scan line coupled to the j-th pixel line of the display unit 10 corresponding to the j-th stage through the output terminal.

The j-th scan signal Gw[j] is a scan signal for selecting a pixel and controlling the switching operation of the pixel to apply a data signal. The j-th scan signal Gw[j] generated by the j-th stage shift register 300 is transmitted to an input terminal of the shift register of the previous stage or the next stage. In the forward driving, the j-th scan signal Gw[j] is transmitted to an input terminal of the (j+1)-th stage shift register 400 of the next stage, and in the backward driving, the j-th scan signal Gw[j] is transmitted to an input terminal of the (j−1)-th stage shift register (see FIG. 5) of the previous stage. Then, in the case of forward driving, the (j+1)-th stage shift register 400, having received the j-th scan signal Gw[j], generates and outputs a (j+1)-th scan signal Gw[j+1] to the output terminal to be transmitted to the plurality of pixels of the (j+1)-th pixel line.

More specifically, the configuration of the j-th stage shift register 300 and the (j+1)-th stage shift register 400 shown in FIG. 6 will now be described. The j-th stage shift register 300 includes a plurality of transistors P1 to P8 and a plurality of capacitors C1 and C2. Likewise, the (j+1)-th stage shift register 400 includes a plurality of transistors P9 to P16 and a plurality of capacitors C10 and C20. Here, the plurality of transistors P1 to P8 and P9 to P16 may be PMOS transistors, but are not limited thereto and may be NMOS transistors. A PMOS transistor includes gate, source, and drain electrodes, and the degree of conductivity is determined according to a difference between a voltage level input to the gate electrode and a voltage of a source terminal.

The j-th stage shift register 300 may receive a scan signal generated at the previous stage or the next stage through two input terminals. The (j−1)-th scan signal Gw[j−1] transmitted from the (j−1)-th stage shift register (see FIG. 5) of the previous stage is transmitted from the source electrode of the first transistor P1 to the drain electrode of the first transistor P1 when the first transistor P1 of the j-th stage shift register 300 is turned on. A signal for controlling the switching operation of the first transistor P1 is the forward driving control signal bi_conB of the scan driver.

Likewise, the (j+1)-th scan signal Gw[j+1] transmitted from the (j+1)-th stage shift register 400 of the next stage is transmitted from the source electrode of the second transistor P2 to the drain electrode of the second transistor P2 when the second transistor P2 of the j-th stage shift register 300 is turned on. A signal for controlling the switching operation of the second transistor P2 is the backward driving control signal bi_con of the scan driver.

Any one of the two scan signals supplied through the two input terminals of the j-th stage shift register 300 is transmitted according to the determination of the driving direction of the scan driver. The forward driving control signal bi_conB and backward driving control signal bi_con for determining the driving direction of the scan driver can determine the orientation of the scan driver because the voltage levels of the signals are inverted. That is, for the forward driving, the first transistor P1 is turned on in response to the forward driving control signal bi_conB during a period (for example, a predetermined period), and for the backward driving, the second transistor P2 is turned in response to the backward driving control signal bi_con during a period (for example, a predetermined period).

If the shift register of the scan driver is at the first stage and the scan driver is driven forward, an input signal transmitted through the first transistor P1 is a forward start signal FLM. On the contrary, if the shift register of the scan driver is at the last stage and the scan driver is driven backward, an input signal transmitted through the second transistor P2 may be a backward start signal FLM.

Meanwhile, the shift register of each stage of the scan driver according to one exemplary embodiment of the present invention receives, in addition to an input signal (scan signal of the previous stage or next stage) transmitted through an input terminal, a first clock signal clk1 having at least two pulses, a second clock signal clk2 having a phase difference of a half-period from the first clock signal clk1, and a first initial signal Int1—generated in synchronization with the second clock signal clk2 or generated after a delay of a time (for example, a predetermined time)—or a second initial signal Int2 generated in synchronization with the first clock signal clk1 or generated after a delay of a time (for example, a predetermined time). Therefore, the shift register of each stage of the scan driver 20 generates a scan signal of the corresponding stage by shifting an input signal (scan signal of the previous stage or next stage) by a period (for example, a predetermined period).

The j-th stage shift register 300 may be assumed, without loss of generality, to be the shift register of an odd-numbered stage, and the (j+1)-th stage shift register 400 may be assumed to be the shift register of an even-numbered stage. Referring to FIG. 6, the circuit configuration of the shift register of each stage constituting the scan driver is substantially the same. The shift register of an odd-numbered stage and the shift register of an even-numbered stage have a structure in which a first clock signal clk1 and a second clock signal clk2 are supplied crossing each other, respectively, to clock signal input terminals. In addition, a first initial signal Int1 and a second initial signal Int2 are supplied in an alternating fashion to an initial signal input terminal.

The first transistor P1 of the j-th stage shift register 300 includes a source electrode for receiving the (j−1)-th scan signal Gw[j−1] transmitted from the (j−1)-th stage shift register of the previous stage, a gate electrode for receiving the forward driving control signal bi_conB, and a drain electrode coupled to the source electrode of the third transistor P3. The second transistor P2 includes a source electrode for receiving the (j+1)-th scan signal Gw[j+1] transmitted from the (j+1)-th stage shift register 400 of the next stage, a gate electrode for receiving the backward driving control signal bi_con, and a drain electrode coupled to the source electrode of the third transistor P3.

The third transistor P3 includes the source electrode coupled to the drain electrode of the first transistor P1 and the drain electrode of the second transistor P2, a gate electrode coupled to the first clock signal clk1, and a drain electrode coupled to one electrode (terminal) of the second capacitor C2. The third transistor P3 transmits the (j−1)-th scan signal Gw[j−1] in the case of forward driving or the (j+1)-th scan signal Gw[j+1] in the case of backward driving to the gate electrode of the seventh transistor P7.

The fourth transistor P4 transmits a first power supply voltage VGH coupled to the source electrode of the fourth transistor P4 through the drain electrode of the fourth transistor P4 to the gate electrode of the eighth transistor P8 in response to the (j−1)-th scan signal Gw[j−1] in the case of forward driving or the (j+1)-th scan signal Gw[$j_+$1] in the case of backward driving. The fifth transistor P5 includes a source electrode coupled to the first power supply voltage VGH, a gate electrode coupled to a first junction Q1 between one electrode (terminal) of the first capacitor C1 and the gate electrode of the eighth transistor P8, and a drain electrode coupled to one electrode (terminal) of the second capacitor C2.

According to another exemplary embodiment, the fifth transistor P5 may include at least two transistors coupled in series, and the at least two transistors may be turned on in response to a second power supply voltage VGL. The switching operation of the fifth transistor P5 is controlled in response to the second power supply voltage VGL transmitted by the sixth transistor P6 that is turned on in response to the first initial signal Int1. When the fifth transistor P5 is turned on, the first power supply voltage VGH is transmitted to the seventh transistor P7.

The sixth transistor P6 includes a source electrode coupled to the second power supply voltage VGL, a gate electrode coupled to the first initial signal Int1, and a drain electrode coupled to the first junction Q1 coupled to one electrode (terminal) of the first capacitor C1, the gate electrode of the eighth transistor P8, and the gate electrode of the fifth transistor P5. The sixth transistor P6 transmits the second power supply voltage VGL to the fifth transistor P5 and the eighth transistor P8 in response to the first initial signal Int1.

The seventh transistor P7 includes a source electrode coupled to the second clock signal clk2, a gate electrode coupled to one electrode (terminal) of the second capacitor C2, and a drain electrode coupled to an output terminal of the shift register 300. The seventh transistor P7 is turned on in response to the (j−1)-th scan signal Gw[j−1] in the case of forward driving or the (j+1)-th scan signal Gw[j+1] in the case of backward driving, and transmits the j-th scan signal Gw[j] to the output terminal to be transmitted to the j-th pixel line at the voltage level of the second clock signal clk2. The output j-th scan signal Gw[j] to be transmitted to the j-th pixel line is supplied to each of the input terminals of the shift registers of the previous stage and next stage.

The eighth transistor P8 includes a source electrode coupled to the first power supply voltage VGH, the gate electrode coupled to the first junction Q1, and a drain electrode coupled to the output terminal of the shift register 300. When the eighth transistor P8 is turned on upon receipt of the second power supply voltage VGL through the sixth transistor P6 (which is turned on in response to the first initial signal Int1), the eighth transistor P8 outputs the first power supply voltage VGH as the j-th scan signal Gw[j] to be transmitted to the j-th pixel line.

The first capacitor C1 includes one electrode (terminal) coupled to the first junction Q1 coupled to the gate electrode of the eighth transistor P8, the gate electrode of the fifth transistor P5, the drain electrode of the sixth transistor P6, and the drain electrode of the fourth transistor P4, and another electrode (terminal) coupled to the first power supply voltage VGH. The second capacitor C2 includes one electrode (terminal) coupled to the gate electrode of the seventh transistor P7 and another electrode (terminal) coupled to the drain electrode of the eighth transistor P8, the drain electrode of the seventh transistor P7, and the output terminal of the shift register 300. A voltage for controlling the switching operation of the seventh transistor P7 is transmitted to a second junction Q2 between one electrode (terminal) of the second capacitor C2 and the gate electrode of the seventh transistor P7.

The (j+1)-th stage shift register 400 is configured likewise by including the ninth to sixteenth transistors P9 to P16 respectively corresponding to the first to eighth transistors P1 to P8 of the j-th stage shift register 300. In addition, the (j+1)-th stage shift register 400 likewise includes the third and fourth capacitors C10 and C20 respectively corresponding to the first and second capacitors C1 and C2 of the j-th stage shift register 300.

However, a second clock signal clk2, a first clock signal clk1, and a second initial signal Int2 are transmitted to the (j+1)-th stage shift register 400, corresponding to the first clock signal clk1, the second clock signal clk2, and the first initial signal Int1 transmitted to the j-th stage shift register 300. A description of a detailed circuit configuration of the elements will not be repeated because the description has been given in the description of the j-th stage shift register 300.

Figure 7:
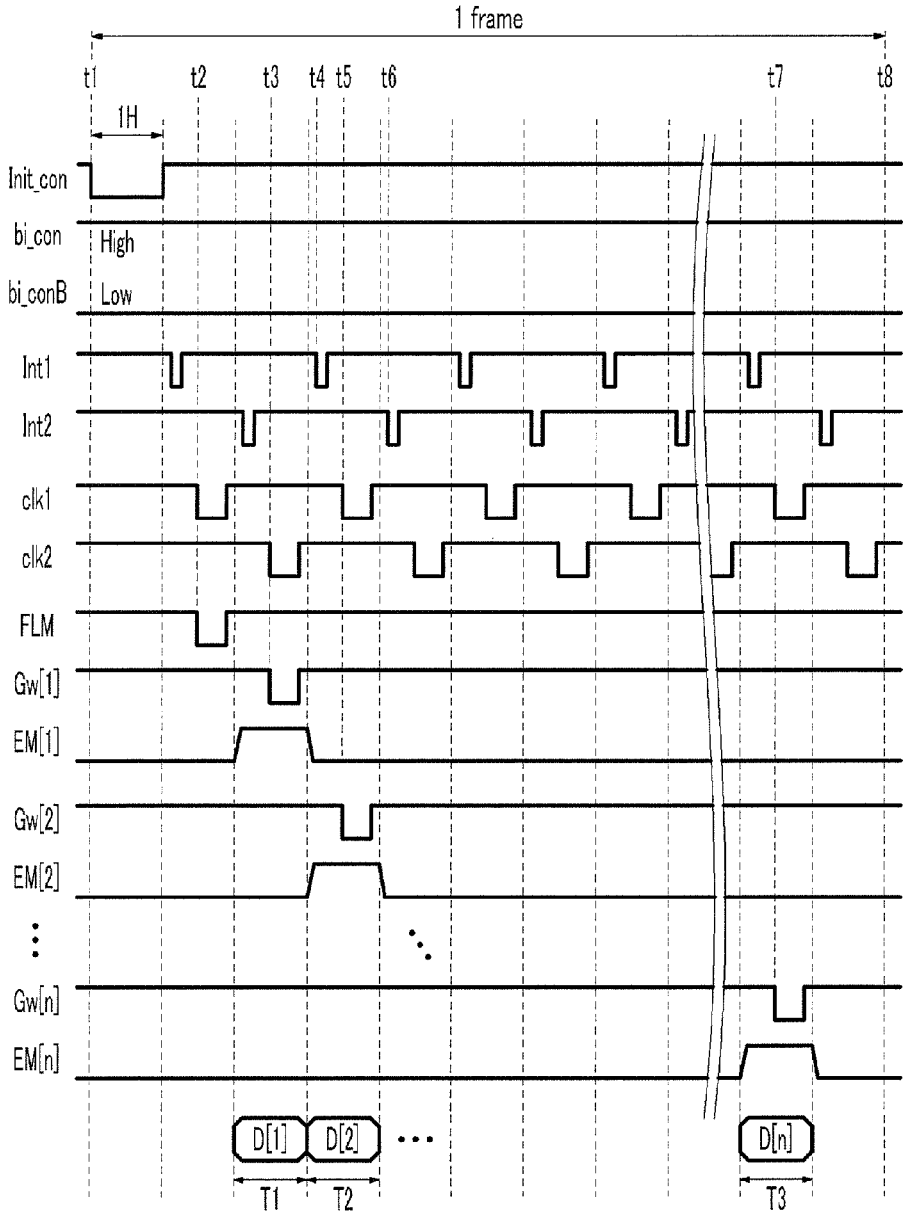
FIG. 7 is a driving waveform diagram illustrating the forward driving of the display device according to one exemplary embodiment of the present invention.
Figure 8:
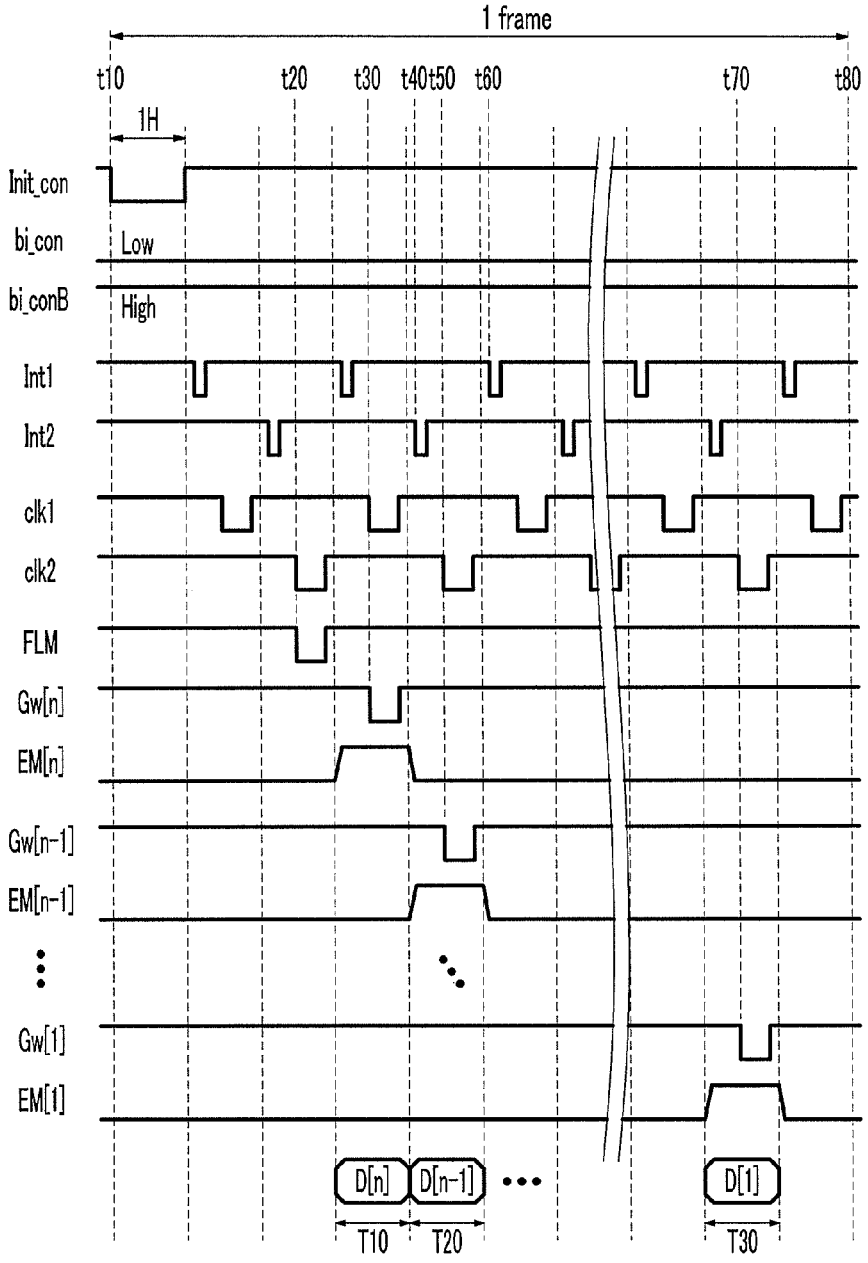
FIG. 8 is a driving waveform diagram illustrating the backward driving of the display device according to one exemplary embodiment of the present invention.

Driving signal waveform diagrams illustrating the driving of the display device including the scan driver having the circuit configuration of FIG. 6 are shown in FIGS. 7 and 8. FIG. 7 is a driving waveform diagram illustrating the forward driving of the display device according to one exemplary embodiment of the present invention. FIG. 8 is a driving waveform diagram illustrating the backward driving of the display device according to one exemplary embodiment of the present invention.

It is assumed that each of periods T1, T2, T3, T10, T20, and T30 for writing and displaying data in FIGS. 7 and 8 corresponds to 1 horizontal (1H) period. In addition, one period of each of the first clock signal clk1, second clock signal clk2, first initial signal Int1, and second initial signal Int2 in the signal waveform diagram of FIGS. 7 and 8 corresponds to 2 horizontal periods.

First, referring to FIG. 7 showing the signal waveform diagram of the display device in which the scan driver performs forward driving, an initialization signal Init_con is transmitted to all of the plurality of pixels of the display unit during a time period (for example, a predetermined time period, such as 1 horizontal period in the exemplary embodiment of FIG. 7) of one frame from the initial time t1 before which the scan driver does not operate on the current frame of data to be displayed. The initialization signal Init_con initializes a data voltage corresponding to a data signal stored in the previous frame of each pixel. After resetting each pixel, the scan driver operates on the current frame of data. The waveform diagram of FIG. 7 illustrates the forward driving of the scan driver.

As it is assumed in the circuit of the scan driver of FIG. 6 that the j-th stage is an odd-numbered stage and the (j+1)-th stage is an even-numbered stage, the first stage of the plurality of shift registers of the scan driver is configured like the j-th stage in one exemplary embodiment of the present invention. Moreover, the plurality of shift registers of the scan driver includes n stages, where n is assumed to be an even number.

During an operating period of the scan driver, a forward driving control signal bi_conB is at a low voltage level, and a backward driving control signal bi_con is at a high voltage level inverted from the forward driving control signal bi_conB. Accordingly, the first transistor P1 of the first stage receiving the forward driving control signal bi_conB is turned on, and the second transistor P2 receiving the backward driving control signal bi_con is turned off.

At time t2, when the third transistor P3 is turned on when the first clock signal clk1 is transmitted as a low-level pulse, an input signal is transmitted through the first transistor P1 and the third transistor P3. Here, the shift register of the first stage transmits a forward start signal FLM as an input signal to be transmitted through the first transistor P1 to the third transistor P3, and the shift register of the following stages transmits a scan signal of the shift register of the previous stage as an input signal to be transmitted through the first transistor P1 to the third transistor P3.

When the low voltage level of the input signal is transmitted to the gate electrode of the seventh transistor P7 (through the third transistor P3), the second clock signal clk2 is transmitted to the output terminal of the shift register of the first stage through the seventh transistor P7 and generated as a first scan signal Gw[1] at time t3. That is, the voltage level of the first scan signal Gw[1] to be transmitted to each of the plurality of pixels of the first pixel line depends on the voltage level of the second clock signal clk2. Concurrently (for example, during the T1 period), a first data signal D[1] is transmitted to corresponding pixels of the first pixel line.

A first emission control signal EM[1], to be transmitted to the first pixel line during the transmission of the first scan signal Gw[1] generated from the shift register of the first stage (that is, during the T1 period), has a high level. Then, the first emission control signal EM[1] falls to a low level at time t4 when the first scan signal Gw[1] changes to a high level, and makes the organic light emitting diode included in each of the pixels emit light (starting in the T2 period) in response to the data signal D[1] transmitted to each of the pixels included in the first pixel line during the T1 period, thereby displaying an image.

Meanwhile, during a period from time t2 to time t3, the forward start signal FLM, which is the input signal of the shift register of the first stage transmitted through the first transistor P1, is transmitted at a low voltage level concurrently (for example, simultaneously) to the gate electrode of the fourth transistor P4 as well. Then, the fourth transistor P4 is turned on to transmit a first power supply voltage VGH to the gate electrode of the eighth transistor P8, and the eighth transistor P8 is turned off. Then, the first power supply voltage VGH of a high voltage level is not output through the eighth transistor P8, and the first output terminal signal Gw[1] of the shift register of the first stage is in accordance with the voltage level of the second clock signal clk2.

Next, the first initial signal Int1 is transmitted as a low-level pulse at time t4 after the first scan signal Gw[1] of the shift register of the first stage is output. Then the sixth transistor P6, having received the first initial signal Int1, is switched on corresponding to the first initial signal Int1, and transmits a second power supply voltage VGL of a low voltage level to the first junction Q1.

At this time, the fifth transistor P5 and eighth transistor P8, to which the second power supply voltage VGL of the low voltage level is applied, are turned on. The first power supply voltage VGH of the high voltage level is transmitted to the second junction Q2 through the fifth transistor P5, and the first power supply voltage VGH of the high voltage level is transmitted as the first output terminal signal Gw[1] of the shift register of the first stage through the eighth transistor P8. Accordingly, the first output terminal signal Gw[1] changes to high level at time t4. At this point, the first power supply voltage VGH transmitted to the second junction Q2 through the fifth transistor P5 is applied to the gate electrode of the seventh transistor P7 to turn off the seventh transistor P7.

The first scan signal Gw[1] generated from the first shift register is transmitted to an input terminal of the second shift register of the next stage according to the forward driving. Then, the second shift register generates a second scan signal Gw[2] by the same driving process as the first shift register.

Specifically, the second shift register transmits the first scan signal Gw[1] to the source electrode of the ninth transistor P9, and the ninth transistor P9, turned on by the forward driving control signal bi_conB, transmits the voltage level of the first scan signal Gw[1] to the eleventh transistor P11. In addition, when the eleventh transistor P11 is turned on in response to the second clock signal clk2 transmitted as a low-level pulse at time t3, the first scan signal Gw[1] of a low voltage level is transmitted to the gate electrode of the fifteenth transistor P15 to turn on the fifteenth transistor P15. Then, the voltage level of the first clock signal clk1 is transmitted to the output terminal of the shift register of the second stage through the fifteenth transistor P15, and the voltage level of the first clock signal clk1 becomes the voltage level of the second scan signal Gw[2] transmitted to the second pixel line. Concurrently (for example, during the T2 period), a second data signal D[2] is transmitted to corresponding pixels of the second pixel line.

Likewise, when a second initial signal Int2 is transmitted at a low voltage level to an initial signal input terminal at time t6, the fourteenth transistor P14 is turned on. Accordingly, the thirteenth transistor P13 and the sixteenth transistor P16 are turned on by the second power supply voltage VGL applied to a first junction Q10 to raise the voltage level of the second scan signal Gw[2] output to the output terminal to the same high level as the first power supply voltage VGH and turn off the fifteenth transistor P15.

A second emission control signal EM[2] to be transmitted to the second pixel line is shifted from a high level to a low level at time t6 (that is, after the T2 period), and the organic light emitting diode of each of the plurality of pixels included in the second pixel line is made to emit light starting in the period after the T2 period, thereby displaying an image corresponding to the second data signal D[2] transmitted to the pixels in the second pixel line during the T2 period.

Scan signals are sequentially generated in a forward direction according to such a driving waveform, and the n-th stage shift register finally generates an n-th scan signal Gw[n]. When the scan signals generated by the plurality of shift registers of the first stage to the n-th stage (that is, the last stage) are transmitted to the plurality of pixel lines, all the pixels of the display unit are scanned and receive a data signal during one frame to display an image. After time t8, an initialization signal Init_con is again transmitted to all the pixels to reset the data voltage and repeatedly start a new frame.

The scan signals sequentially output from the shift registers of the respective stages are transmitted to the scan lines of each of the plurality of pixel lines with a phase difference equal to a period from time t3 to time t5. In FIG. 7, the phase difference equals a period (1 horizontal period) corresponding to the phase difference between the first clock signal clk1 and the second clock signal clk2, which is also half of the period of the first clock signal clk1 and the second clock signal clk2. The phase difference may be adjusted in various ways according to other exemplary embodiments of the present invention.

FIG. 8 is a signal waveform diagram of the backward driving of the scan driver 20 according to the exemplary embodiment shown in FIG. 6. Each of the shift registers included in the scan driver of FIG. 8 operates in the same manner as in FIG. 7, so a detailed description thereof will not be repeated.

FIG. 8 illustrates backward driving. Thus, during an operating period (for example, a predetermined operating period), a backward driving control signal bi_con is at a low voltage level, and a forward driving control signal bi_conB is at a high voltage level inverted from the backward driving control signal bi_con. Therefore, the shift register of each stage receives, as an input signal, a scan signal generated from a next (that is, lower stage) shift register through the transistor (second or tenth transistor P2 or P10 in FIG. 6) turned on in response to the backward driving control signal bi_con. Consequently, the n-th stage shift register of the last stage, being an even-numbered stage, is driven backward with the same circuit configuration as the (j+1)-th stage shift register 400 of FIG. 6.

In the waveform diagram of FIG. 8, regarding the order of generation of scan signals, scan signals are generated first through high-numbered (that is, lower stage) shift registers and then through low-numbered (that is, upper stage) shift registers. Accordingly, an input signal applied to an input terminal of the shift register of the last stage is a backward start signal FLM. In the driving of FIG. 8 as well, an initialization signal Init_con is supplied to all the pixels at the initial time t10 of one frame to reset the pixels.

The n-th stage shift register of the last stage is first driven. When the second clock signal clk2 is transmitted to the gate electrode of the eleventh transistor P11 at time t20, the eleventh transistor P11 is turned on to transmit the backward start signal FLM, which is the input signal transmitted through the tenth transistor P10, to the gate electrode of the fifteenth transistor P15.

Then, the n-th stage scan signal Gw[n] corresponding to the voltage level of the first clock signal clk1 is output through the fifteenth transistor P15 at time t30. Like the process of FIG. 7, the n-th scan signal Gw[n] generated from the n-th stage shift register is transmitted to an input terminal of the (n−1)-th stage shift register of a previous (that is, an upper) stage to generate an (n−1)-th stage scan signal Gw[n−1] at time t50.

According to one exemplary embodiment of the present invention, all the pixels of the display unit are initialized at an initial time of a frame. Thus, the scan driver according to one exemplary embodiment of the present invention can avoid the complexity of circuit configuration and design by not including a circuit for generating or controlling a scan signal for initializing the pixels of the display unit while having the bi-directional driving function, which can reduce panel D/S by reducing the area occupied by the elements.

Figure 9:
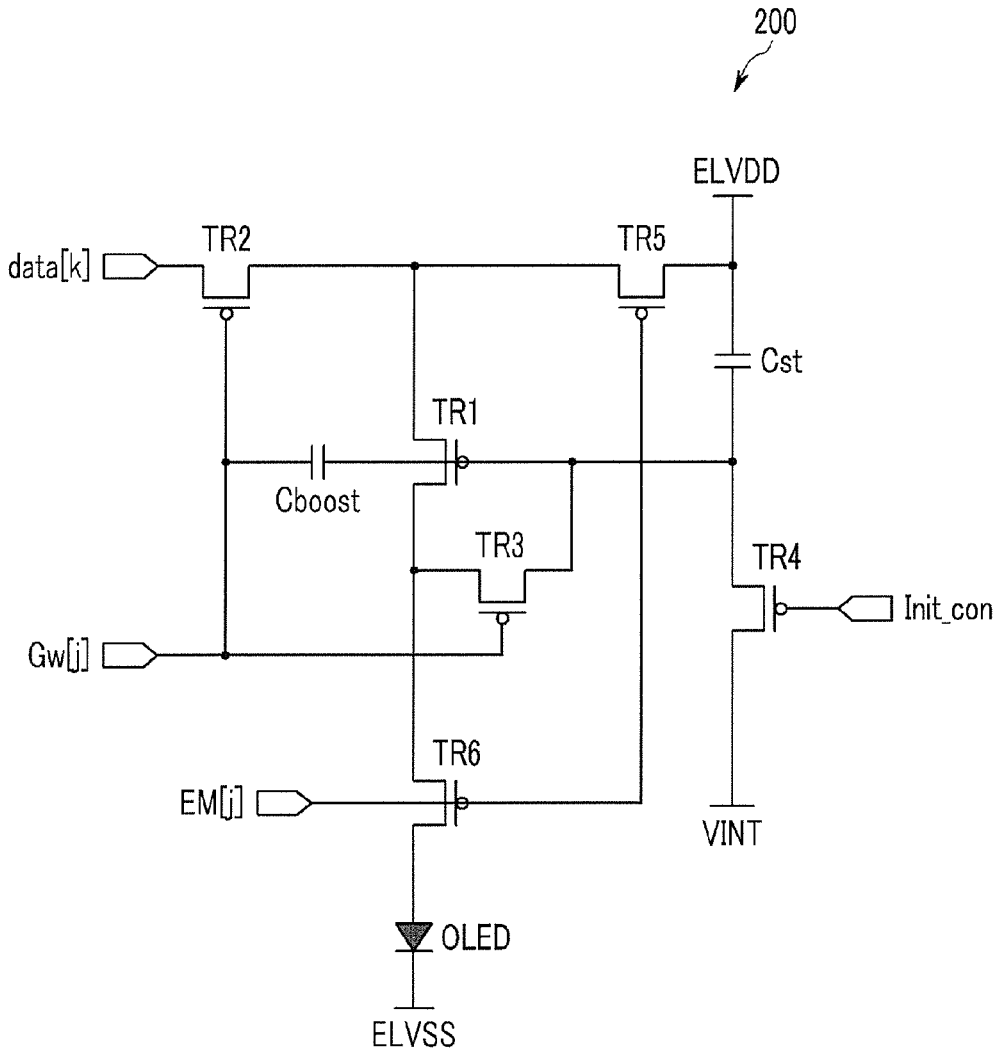
FIG. 9 is a circuit diagram of a pixel of a display device according to one exemplary embodiment of the present invention.

FIG. 9 shows a circuit diagram of a pixel 200 of a display device according to one exemplary embodiment of the present invention.

Specifically, in the display device of FIG. 1, a description will be made of an example pixel 200, among a plurality of pixels included in the j-th pixel line of a plurality of pixel lines included in the display unit 10. The pixel 200 (see pixel PXjk in FIG. 1) is coupled to the j-th scan line Gwj, coupled to the j-th emission control line EMj coupled to the emission control driver 40, and coupled to the k-th data line Dk among a plurality of data lines coupled to the data driver 30. In addition, the pixel 200, along with the other pixels, is coupled to the initialization control line INITC coupled to the initialization control driver 70 to receive an initialization signal.

The circuit diagram shown in FIG. 9 is merely an illustration of one exemplary embodiment, and other embodiments of the present invention are not necessarily limited to such a circuit structure. Although the plurality of transistors constituting the pixel 200 are illustrated as being PMOS transistors, they may also be NMOS transistors.

The pixel 200 of FIG. 9 includes an initialization transistor TR4 coupled between an initialization voltage VINT and a gate electrode of a driving transistor TR1, the driving transistor TR1 coupled between a driving power supply voltage ELVDD and an anode of an organic light emitting diode OLED, a switching transistor TR2 coupled to a k-th data line Dk (for transmitting a k-th data signal data[k]) corresponding to a source electrode of the driving transistor TR1, an emission control transistor TR6 coupled between a drain electrode of the driving transistor TR1 and the anode of the organic light emitting diode OLED, and a storage capacitor Cst coupled between the gate electrode of the driving transistor TR1 and the source electrode of the driving transistor TR1.

Specifically, the switching operation of the initialization transistor TR4 is controlled in response to the initialization signal Init_con generated and transmitted from the initialization control driver 70 of the display device. As discussed in detail in FIGS. 7 and 8, when the initialization signal Init_con is transmitted to all the pixels during an initial period (for example, an initial predetermined period) of the corresponding frame and all the initialization transistors TR4 are turned on, the initialization voltage VINT is transmitted to the gate electrode of the driving transistor TR1 to reset the voltage value of the gate electrode of the driving transistor TR1 to the initialization voltage VINT.

Then, the switching transistor TR2 is switched on in response to the j-th scan signal Gw[j] sequentially generated through the plurality of shift registers corresponding to a j-th pixel line in the scan driver 20. Then, the data signal data[k] is transmitted to the driving transistor TR1 through the corresponding data line Dk.

The pixel 200 according to the exemplary embodiment of FIG. 9 may further include a threshold voltage compensation transistor (e.g., switch) TR3 coupled between the gate electrode and drain electrode of the driving transistor TR1. The j-th scan signal Gw[j] to be transmitted to the switching transistor TR2 is concurrently (for example, simultaneously) transmitted to a gate electrode of the threshold voltage compensation transistor TR3, and the threshold voltage compensation transistor TR3 operates in response to the j-th scan signal Gw[j]. When the threshold voltage compensation transistor TR3 is turned on, the driving transistor TR1 is diode-connected to compensate for a threshold voltage of the driving transistor.

Therefore, the switching transistor TR2 and the threshold voltage compensation transistor TR3 receive the same j-th scan signal Gw[j] at their gate electrodes, and accordingly perform switching operations. Thus, a data signal is transmitted to the pixel 200 during the period in which the threshold voltage of the driving transistor TR1 is compensated for. Then, the driving transistor TR1 transmits a driving current corresponding to the data signal data[k] transmitted through the switching transistor TR2 to the organic light emitting diode OLED. The pixel 200 may further include a boosting capacitor Cboost coupled between the gate electrode of the driving transistor TR1 and the gate electrode of the switching transistor TR2.

The emission control transistor TR6 is positioned between the drain electrode of the driving transistor TR1 and the anode of the organic light emitting diode OLED, and performs its switching operation by receiving a j-th emission control signal EM[j]. When the emission control transistor TR6 is turned on, the driving current corresponding to the data signal flows into the organic light emitting diode OLED to display an image. According to the exemplary embodiment of FIG. 9, another emission control transistor TR5 may be further provided between the driving power supply voltage ELVDD and the source of the driving transistor TR1.

As explained in the circuit diagram and signal waveform diagram of FIGS. 6 to 8, if the scan driver performs bi-directional driving, the number of circuit devices may increase and, accordingly, the number of elements may increase. According to the driving method of embodiments of the present invention, an initialization signal may be separately generated and controlled by a separate device. This prevents the configuration of the scan driver from becoming complicated, and enables the pixel 200 to be stably reset all the time in response to the initialization voltage VINT.

While the present invention has been described with reference to specific exemplary embodiments, this is for illustrative purposes only and the present invention is not limited thereto. It is to be appreciated that those skilled in the art can change or modify the embodiments without departing from the scope and spirit of the present invention. Such changes and modifications can be made without departing from the scope of the present invention. Further, the materials of the respective constituent elements described in this specification can be easily selected from various known materials and replaced by those having ordinary skill in the art. Further, those having ordinary skill in the art may omit some of the constituent elements described in this specification without degrading performance, or add a constituent element(s) in order to improve the performance. In addition, those having ordinary skill in the art may change the sequence of the method steps described in this specification according to process environment or equipment. Therefore, it is to be understood that the scope of the invention should be considered in light of the appended claims and equivalent arrangements, and not necessarily limited by the disclosed embodiments.

DESCRIPTION OF SELECTED REFERENCE NUMERALS

10: display unit
20: scan driver
30: data driver
40: emission control driver
50: signal controller
60: power supply unit
70: initialization control driver
100: display device
200: pixel While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims, and their equivalents.

What is claimed is:

1. A display device comprising:

a display unit comprising pixels arranged in a plurality of pixel lines;

a scan driver for respectively transmitting a corresponding plurality of scan signals to the plurality of pixel lines during a corresponding plurality of horizontal periods of one frame, the one frame comprising an initialization period followed by all of the plurality of horizontal periods;

a data driver for transmitting data signals to the pixels after the initialization period and during the plurality of horizontal periods, the data signals for storing corresponding data voltages in the pixels; and an initialization control driver for concurrently generating and transmitting an initialization signal to all of the pixels during the initialization period of the one frame separate from and preceding any and all of the plurality of horizontal periods of the one frame, to concurrently initialize the data voltages corresponding to the data signals of a previous frame stored in all of the pixels during the initialization period and before any and all of the plurality of horizontal periods, wherein the scan driver comprises a plurality of shift registers for generating the scan signals respectively corresponding to the plurality of pixel lines, and a shift register of the plurality of shift registers is configured to receive, as a first input signal, one of the scan signals generated from one of the plurality of shift registers adjacent to the shift register in synchronization with a first clock signal, to transmit the first input signal through a first switch in response to the first clock signal, to transmit a second clock signal through a second switch in response to the first input signal as transmitted through the first switch, and to output, as another one of the scan signals, either the second clock signal as transmitted through the second switch or a first power supply voltage corresponding to the first input signal.

2. The display device of claim 1, further comprising a signal controller for generating a plurality of control signals to control the driving of the scan driver, the data driver, and the initialization control driver, and for transmitting the control signals to the scan driver, the data driver, and the initialization control driver.

3. The display device of claim 2, wherein the plurality of shift registers is configured to be sequentially driven in a forward or backward direction.

4. The display device of claim 3, wherein the control signals comprise a forward driving control signal and a backward driving control signal for controlling the sequential driving of the shift registers in the forward direction or the backward direction.

5. The display device of claim 4, wherein the forward driving control signal is an inverse of the backward driving control signal.

6. The display device of claim 1, wherein the initialization period is set to an initial period of the frame.

7. The display device of claim 1, wherein each of the pixels comprises:

an organic light emitting diode;

a driving transistor for transmitting a driving current in accordance with a corresponding one of the data signals to the organic light emitting diode;

an initialization transistor for applying an initialization voltage to a gate electrode of the driving transistor in response to the initialization signal, to reset a voltage of the gate electrode;

a switching transistor for transmitting the corresponding one of the data signals to the driving transistor in response to a corresponding one of the scan signals; and a first capacitor coupled between the gate electrode and a source electrode of the driving transistor.

8. The display device of claim 7, wherein each of the pixels further comprises a threshold voltage compensation transistor coupled between the gate electrode and a drain electrode of the driving transistor, for diode-connecting the driving transistor in response to the corresponding one of the scan signals.

9. The display device of claim 1, wherein the plurality of shift registers is configured to be sequentially driven in a forward or backward direction.

10. The display device of claim 9, wherein the shift register is further configured to:

generate and transmit the other one of the scan signals as an input signal to a next shift register adjacent to the shift register from among the plurality of shift registers when a driving direction of the plurality of shift registers is the forward direction; and generate and transmit the other one of the scan signals as an input signal to a previous shift register adjacent to the shift register from among the plurality of shift registers when a driving direction of the plurality of shift registers is the backward direction.

11. The display device of claim 10, wherein the next shift register and the previous shift register are configured to generate yet another one of the scan signals by receiving the input signal and shifting the received input signal by one of the plurality of horizontal periods.

12. The display device of claim 9, wherein the plurality of shift registers comprises odd-numbered shift registers and even-numbered shift registers, and an odd-numbered shift register of the odd-numbered shift registers is configured to receive, as the first input signal, the one of the scan signals generated from one of the even-numbered shift registers adjacent to the odd-numbered shift register in synchronization with the first clock signal, and to output, as the other one of the scan signals, either the second clock signal or the first power supply voltage corresponding to the first input signal.

13. The display device of claim 12, wherein the odd-numbered shift register comprises:

a first transistor configured to turn on in response to a forward driving control signal to transmit, as the first input signal, the one of the scan signals generated from a previous one of the even-numbered shift registers adjacent to the odd-numbered shift register;

a second transistor configured to turn on in response to a backward driving control signal to transmit, as the first input signal, the one of the scan signals generated from a next one of the even-numbered shift registers adjacent to the odd-numbered shift register;

a third transistor constituting the first switch and configured to turn on in response to the first clock signal to transmit the first input signal;

a fourth transistor configured to turn on in response to the first input signal to transmit the first power supply voltage;

a fifth transistor configured to turn on in response to a second power supply voltage transmitted corresponding to a first initial signal, to transmit the first power supply voltage;

a sixth transistor configured to turn on in response to the first initial signal to transmit the second power supply voltage to a first node coupled to a gate electrode of the fifth transistor;

a seventh transistor constituting the second switch and configured to turn on in response to the first input signal transmitted through the third transistor, to output the second clock signal as the other one of the scan signals; and an eighth transistor configured to turn on in response to the second power supply voltage transmitted to the first node, to output the first power supply voltage as the other one of the scan signals.

14. The display device of claim 13, wherein the odd-numbered shift register further comprises:

a first capacitor comprising one terminal coupled to the first node and another terminal coupled to the first power supply voltage; and a second capacitor comprising one terminal coupled to a gate electrode of the seventh transistor and another terminal coupled to an output terminal of the odd-numbered shift register.

15. The display device of claim 13, wherein the first initial signal is generated in synchronization with the second clock signal or with a delay, and a second initial signal is generated in synchronization with the first clock signal or with a delay.

16. The display device of claim 12, wherein the second clock signal has a phase difference with the first clock signal equal to a half of a period of the first clock signal.

17. The display device of claim 9, wherein the plurality of shift registers comprises odd-numbered shift registers and even-numbered shift registers, and an even-numbered shift register of the even-numbered shift registers is configured to receive, as a second input signal, the other one of the scan signals generated from one of the odd-numbered shift registers adjacent to the even-numbered shift register in synchronization with the second clock signal, to transmit the second input signal through a third switch in response to the second clock signal, to transmit the first clock signal through a fourth switch in response to the second input signal as transmitted through the third switch, and to output, as yet another one of the scan signals, either the first clock signal as transmitted through the fourth switch or the first power supply voltage corresponding to the second input signal.

18. The display device of claim 17, wherein the even-numbered shift register comprises:

a ninth transistor configured to turn on in response to a forward driving control signal to transmit, as the second input signal, the other one of the scan signals generated from a previous one of the odd-numbered shift registers adjacent to the even-numbered shift register;

a tenth transistor configured to turn on in response to a backward driving control signal to transmit, as the second input signal, the other one of the scan signals generated from a next one of the odd-numbered shift registers adjacent to the even-numbered shift register;

an eleventh transistor constituting the third switch and configured to turn on in response to the second clock signal to transmit the second input signal;

a twelfth transistor configured to turn on in response to the second input signal to transmit the first power supply voltage;

a thirteenth transistor configured to turn on in response to a second power supply voltage transmitted corresponding to a second initial signal, to transmit the first power supply voltage;

a fourteenth transistor configured to turn on in response to the second initial signal to transmit the second power supply voltage to a second node coupled to a gate electrode of the thirteenth transistor;

a fifteenth transistor constituting the fourth switch and configured to turn on in response to the second input signal transmitted through the eleventh transistor, to output the first clock signal as the yet other one of the scan signals; and a sixteenth transistor configured to turn on in response to the second power supply voltage transmitted to the second node, to output the first power supply voltage as the yet other one of the scan signals.

19. The display device of claim 18, wherein the even-numbered shift register further comprises:

a third capacitor comprising one terminal coupled to the second node and another terminal coupled to the first power supply voltage; and a fourth capacitor comprising one terminal coupled to a gate electrode of the fifteenth transistor and another terminal coupled to an output terminal of the even-numbered shift register.

20. The display device of claim 18, wherein a first initial signal is generated in synchronization with the second clock signal or with a delay, and the second initial signal is generated in synchronization with the first clock signal or with a delay.

21. The display device of claim 17, wherein the second clock signal has a phase difference with the first clock signal equal to a half of a period of the first clock signal.

22. A driving method of a display device, the display device comprising: pixels arranged in a plurality of pixel lines, a scan driver for respectively transmitting a corresponding plurality of scan signals to the plurality of pixel lines during a corresponding plurality of horizontal periods of one frame, and an initialization control driver for transmitting an initialization signal to the pixels during an initialization period of the one frame separate from and preceding any and all of the plurality of horizontal periods of the one frame, the scan driver comprising a plurality of shift registers for generating the scan signals respectively corresponding to the plurality of pixel lines, a shift register of the plurality of shift registers being configured to receive, as a first input signal, one of the scan signals generated from one of the plurality of shift registers adjacent to the shift register in synchronization with a first clock signal, each of the pixels comprising: an organic light emitting diode; a driving transistor for controlling a current supplied to the organic light emitting diode; a switching transistor for transmitting a data signal to the driving transistor; an initialization transistor for transmitting an initialization voltage to a gate electrode of the driving transistor; and a capacitor coupled between the gate electrode and a source electrode of the driving transistor, the method comprising:

concurrently transmitting the initialization signal to all of the pixels during the initialization period of the one frame and prior to any and all of the plurality of horizontal periods of the one frame, to concurrently initialize a gate electrode voltage of the driving transistor of each of the pixels to the initialization voltage; and sequentially transmitting the corresponding plurality of scan signals to the plurality of pixel lines during the corresponding plurality of horizontal periods of the one frame separate from and following the initialization period of the one frame, to display an image by a driving current corresponding to the data signal for each of the pixels, the sequentially transmitting of the corresponding plurality of scan signals comprising, by the shift register:

transmitting the first input signal through a first switch in response to the first clock signal;

transmitting a second clock signal through a second switch in response to the first input signal as transmitted through the first switch; and outputting, as another one of the scan signals, either the second clock signal as transmitted through the second switch or a first power supply voltage corresponding to the first input signal.

23. The method of claim 22, wherein each of the pixels further comprises a threshold voltage compensation transistor coupled between the gate electrode and a drain electrode of the driving transistor, and the method further comprises compensating for a threshold voltage in each of the pixels by turning on the threshold voltage compensation transistor to diode-connect the driving transistor when a corresponding one of the scan signals is transmitted.

24. The method of claim 22, further comprising choosing a scan driving direction from among a forward direction and a backward direction, wherein the sequentially transmitting of the corresponding plurality of scan signals to the plurality of pixel lines further comprises sequentially transmitting the corresponding plurality of scan signals according to the chosen scan driving direction.

* * * * *